United States Patent [19]

Tippmer et al.

[11] Patent Number: 4,793,834

[45] Date of Patent: Dec. 27, 1988

[54] PROCESS FOR COOLING CRUDE COKE OVEN GAS

[75] Inventors: Kurt Tippmer, Recklinghausen; Georg Abendroth, Duelmen, both of Fed. Rep. of Germany

[73] Assignee: Carl Still GmbH & C.KG, Fed. Rep. of Germany

[21] Appl. No.: 43,917

[22] Filed: Apr. 29, 1987

[30] Foreign Application Priority Data

May 2, 1986 [DE] Fed. Rep. of Germany ..... 3614851

[51] Int. Cl.[4] ..... B01D 3/16; B01D 1/14; B01D 45/02

[52] U.S. Cl. ..... 55/85; 55/89; 55/94; 55/223; 55/228; 55/257 HE; 55/267; 55/257.7

[58] Field of Search ..... 55/85, 89, 93, 94, 223, 55/228, 257 R, 257 HE, 267

[56] References Cited

U.S. PATENT DOCUMENTS

| | | | |
|---|---|---|---|
| 965,147 | 7/1910 | Feld | 55/85 |
| 1,053,349 | 2/1913 | Blauvelt et al. | 55/93 |
| 1,830,178 | 11/1931 | Sperr, Jr. | 55/85 |
| 1,937,460 | 11/1933 | Muhlendyck | 55/85 |
| 2,129,787 | 9/1938 | Schmalenbach | 55/89 |
| 2,699,225 | 1/1955 | Dahlbeck | 55/94 |
| 2,747,680 | 5/1956 | Kilpatrick | 55/85 |
| 2,810,450 | 10/1957 | Hartmann | 55/94 X |
| 2,972,393 | 2/1961 | Bush | 55/94 X |
| 3,581,472 | 6/1971 | Grosick | 55/94 X |
| 4,065,273 | 12/1977 | Rudolph | 55/85 X |
| 4,149,971 | 4/1979 | Deuser et al. | 55/85 X |
| 4,154,584 | 5/1979 | Ullrich | 55/85 |
| 4,234,389 | 11/1980 | Lynn et al. | 55/89 X |
| 4,247,365 | 1/1981 | Weber et al. | 55/85 X |
| 4,286,971 | 9/1981 | Burcaw, Jr. et al. | 55/85 X |
| 4,309,253 | 1/1982 | Beck et al. | 55/85 X |

FOREIGN PATENT DOCUMENTS

| | | | |
|---|---|---|---|
| 2652499 | 5/1978 | Fed. Rep. of Germany | 55/85 |
| 311326 | 10/1930 | United Kingdom | 55/93 |
| 317780 | 11/1930 | United Kingdom | 55/93 |

*Primary Examiner*—Robert Spitzer
*Attorney, Agent, or Firm*—McGlew and Tuttle

[57] ABSTRACT

This invention concerns a process for cooling the crude coke oven gas drawn from a gas collecting main at a gas temperature of below 20° C. after separating a collecting main flushing liquid fed to a tar separator. To prevent deposists of naphthalene on the cooling tubes of a precooler, the invention provides that the crude coke oven gas is treated before the precooler with tar or a tar-water mixture withdrawn from the tar separator. This effects a partial evaporation of the more volatile components, and the remaining tar or tar-water mixture is again withdrawn before the precooler. A flushing liquid from the edge zone of the tar separator that has definite proportions of low-solids and lighter tar is used in particular and it is fed in parallel with the cooling crude gas in the precooler.

13 Claims, 2 Drawing Sheets

PROCESS FOR COOLING CRUDE COKE OVEN GAS

FIELD AND BACKGROUND OF THE INVENTION

This invention relates in general to coking and in particular to a new and useful process for cooling crude coke oven gas.

This invention concerns a process for cooling the crude coke oven gas drawn from a gas collecting main down to a gas temperature of less than 20° C. after separating the collecting main flushing liquid fed to a tar separator.

The crude coke oven gases produced in the coking of coal in coking furnaces comprise primarily uncondensable coke oven gas, $H_2$, $CH_4$, etc., and condensable and absorbable fractions such as tar, crude benzene, water, ammonia, hydrogen sulfide, carbon dioxide, and hydrogen cyanide.

In the cooling of the hot gases at a temperature of 800° to 900° C. by a water spray in the gas collecting main down to 80° to 82° C., a major fraction of the tar constituents is condensed out, while the lower-boiling fraction of the tar is fed with the gas and the other components to the indirect or direct gas precoolers for further cooling, as a rule to 20° to 30° C. When leaving the collecting main, the crude gas is saturated with steam. During the further cooling of the gas in the coolers, the water fraction and other tar constituents condense. One component of the tar is naphthalene, which can then sublime directly out of the vaporphase during the further cooling of the crude gas into the solid phase, when there is no longer equilibrium between the condensed components, i.e., when the dissolving power of the condensed components, i.e., when the dissolving power of the condensed tar and of the water for naphthalene is exceeded. In such a case, naphthalene is deposited on the cooling surfaces of the precooler.

A process is know from German patent application Disclosure No. 26 52 499 for the treatment of coking plant gas in an indirect precooler after separating the collecting main flushing liquid fed to a tar separator, in which the precooler is divided into two stages and the condensate forming in the precooler is fed to a tar sink from which a liquid is withdrawn that is enriched with tar, with which the gas is sprayed between the two stages, with the spraying of the gas taking place before its temperature has dropped below the temperature at which naphthalene is deposited from the gas.

Unfortunately, practical experience shows that this process is unsuitable for cooling the coke plant gas to a sufficiently low level. Since no additional flushing tar is used, the temperature limit is determined by the formation capability of the tar condensed out in the cooler. It has been found that the naphthalene saturation limit of the tar-naphthalene mixture, forming after the precooler, is exceeded even at a crude gas temperature of 25° C., and the familiar plugging occurs in the lower area of the precooler. In practice, the first plugging occurs even at approx. 28° C.

On the other hand, it is a problem to supply the condensate forming directly to the separator, since emulsions can form there.

SUMMARY OF THE INVENTION

The invention provides a process for cooling coke oven gases when an adequate amount of solvent for the sublimed naphthalene is constantly present in the gas cooler even at low crude gas temperatures, especially below 20° C., and that this amount of solvent is provided in the simplest possible way with the crude tar or its fractions present in the crude gas.

The solution of this problem pursuant to the invention provides that the crude coke oven gas is treated before the precooler with tar or a tar-water mixture withdrawn from the tar separator, with partial evaporation of the more volatile components, and the remaining tar or tar-water mixture is again drawn off before the precooler. By adding the crude tar to the hot gas stream at 80° to 82° C. through an evaporation zone, the amount of light tar condensing out in the precooler is increased by 20 to 30% with an increase of the fraction with a boiling point up to 200° C. from 16% to 30%. At that same time, the crude gas in the evaporation zone is relieved of dust particles to a great extent by the countercurrent crude tar scrubbing. The increase of the proportion of tar boiling up to 200° C. and the reduction of the dust fraction substantially improve overall the flowability and the dissolving power of the light tar for naphthalene, so that final cooler temperatures down to approx. 15° C. are possible. With the previous precooler systems, there was the risk of plugging by the naphthalene-tar mixture when cooling to below 20° C.

It has proved desirable pursuant to the invention to add a tar-water emulsion with a tar fraction of 50 to 100 g/l in the evaporation zone. In addition, a tar-water emulsion is loaded into the precooler at the top, with the amount being determined by the temperature and the dissolving power for naphthalene. In the case of final gas temperatures of 18° to 20° C. with a naphthalene solubility limit of 10 to 12 wt.%, the problem can still be solved by recycling all of the crude tar in the form of a tar-water emulsion that is drawn off from the edge zone of the tar separator at several points on the circumference.

However, a sharp reduction of the tar flowability is found already at temperatures below 18° C., so that steps must be taken that again improve it.

It is proposed for this, pursuant to the invention, that the hot crude gas at 80° to 82° C. is treated with a light tar-water mixture from the tar separator with the fraction of tar in this mixture boiling below 200° C. being 1.5 to two times as high as in the total crude tar. Because of this step, the fraction boiling up to 200° C. is generally evaporated into the gas in the evaporation zone, and the lower-boiling fraction is thus increased. This measure reduces the naphthalene content in the tar discharged from the precooler at a gas temperature, for example, of 15° C., to 14 to 15 wt.%, and a lower-boiling fraction of more than 25 wt.%. In the normal case, i.e., without this step, the naphthalene content would be approx. 20 wt.% and the low-boiling fraction would be lower. The discharged mixture of water and tar containing naphthalene is beneficially recycled to the collecting main as additional feedstock flushing.

In accordance with the invention, it is also provided that the tar-water emulsion with increased proportion of lower-boiling tar used for addition to the crude gas is withdrawn from the edge zone of the tar separator at several points on the circumference. Studies have confirmed that the tar in the edge zone of the tar separator in the region of the separating line has a fraction of approximately 4 to 5% of light tar boiling below 200° C., while the production tar that is drawn off at the other end, i.e., in the center of the tar separator, has only approximately 2%.

It has also been confirmed that an emulsion layer is formed in the condensate tank for the light tar-water mixture discharged from the precooler, whose fraction of light tar boiling up to 200° C. is more than 10%. The invention therefore proposes that the light tar-water mixture discharged from the precooler is divided into two or more fractions in a multipart condensate tank. One fraction, with a high proportion of light tar boiling below 200° C., is sprayed into the crude gas before the precooler, and the fraction not evaporating and the rest of the tar-water mixture is used for spraying the collecting main. The light tar-water emulsion from the condensate tank is recycled by evaporation into the hot crude gas at 80° to 82° C. before the precooler, so that the principal amount containing naphthalene does not pass through the precooler again. Because of this step pursuant to the invention, the light tar in the discharge from the precooler at a gas temperature of 15° C. has a fraction of up to 20% of tar boiling below 200° C. and a naphthalene dissolving power of distinctly above 14%.

To carry out the process pursuant to the invention, it is proposed, finally, that the evaporation zone for charging the crude tar-water mixture comprises a vertical section of pipe, as a countercurrent scrubber. The gas is drawn off at the top of the section of pipe and the nonvaporizing tar-water mixture runs out of the section of pipe at the bottom.

The process pursuant to the invention makes it possible to cool the crude gas in the precoolers to far below 20° C. This provides substantial economic benefits for the following gas purification systems (in this regard, cf. "Bergbau", Number 8, August 1985, pages 379 ff).

Accordingly it is an object of the invention to provide a process for cooling crude coke which is drawn from a coke gas collecting main which has crude coke oven gas and a flushing liquid wherein the coke is cooled down to a temperature below 20° C. and comprising separating the collecting main flushing liquid from the crude coke oven gas by feeding it to a tar separator, treating the separated crude coke oven gas with a water mixture which is withdrawn from the tar separator, partially evaporating the more volatile components, driving off the remaining tar and tar-water mixture from the coke oven gas and directing the gas to a precooler.

A further object of the invention is to provide a process for cooling crude coke oven gas which is inexpensive to carry out and makes economical use of the energy and parts.

DESCRIPTION OF THE PREFERRED EMBODIMENTS

Figure 1:
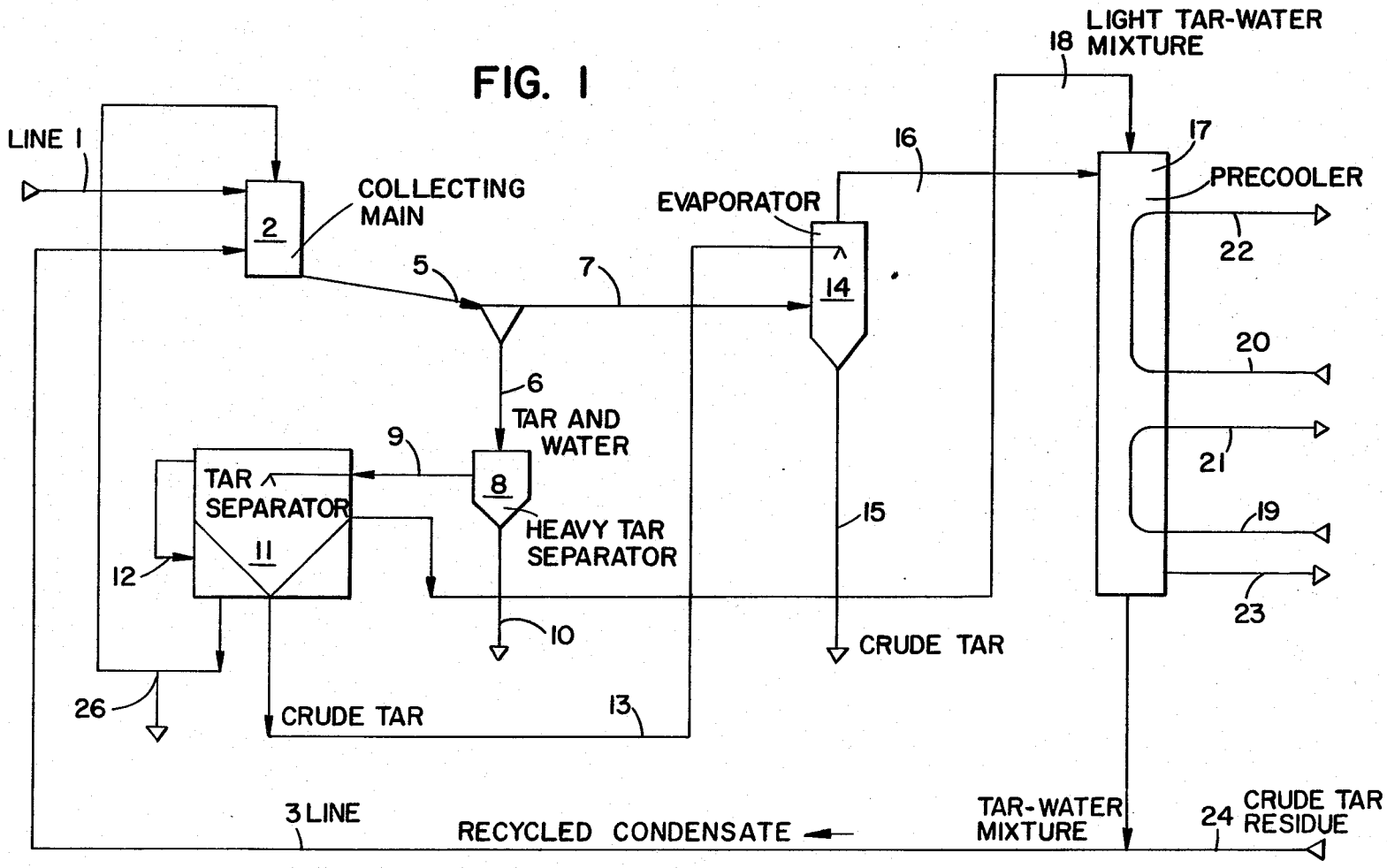
FIG. 1 is a schematic of a process for cooling crude coke in accordance with the invention.

In the numerical examples, we assume that 344 $m^3$ (standard) of gas is formed from 1 ton of feedstock coal (waf) with 25 wt.% of volatile components (waf), that arrives at the collecting main 2 through the line 1 at a temperature of approx. 850° C. This gas contains:

| | |
|---|---|
| Crude tar (RT) | 30.8 kg (without $C_{10}H_8$) |
| Naphthalene ($C_{10}H_8$) | 3.4 kg |
| BTX | 11.2 kg |

After spraying with recycled condensate from line 3 and spray water from line 4 (line 4 being connected to tar separator 11 near water discharge 12 and line 4 being connected to excess coal water discharge 26), crude gas, tar, and rinse water (temperature 81° C., RT 36.8 kg, $C_{10}H_8$ 4.9 kg, BTX 13.4 kg) are drawn off through the line 5. Through line 6, the tar and water (RT 30.8 kg, $C_{10}H_8$ 3.6 kg, BTX 2.2 kg) arrive at the heavy tar separator 8, from which the heavy tar is removed in the usual way through the drain 10. Tar and water pass through the line 9 into the tar separator 11. According to the form of embodiment of FIG. 1, all of the crude tar forming at the bottom of the tar separator is pumped through the line 13 to the evaporation zone 14 for the treatment of the hot crude gas. Essentially the crude tar boiling only above 200° C. (RT 30.8 kg, $C_{10}H_8$ 3.6 kg, BTX 1.0 kg) is drawn off for further use through the drain 15. The crude gas enriched with low-boiling tar constituents is fed through line 16 (RT 6.0 kg, $c_{10}H_8$ 1.3 kg, BTX 12.4 kg) to the precooler 17, and is cooled there by the two cooling water loops 19 to 22 to a crude gas temperature of 15° C. (RT 0.8 kg, $C_{10}H_8$ 0.1 kg, BTX 10.2 kg), and is drawn off through line 23. A tar-water mixture (RT 5.2 kg, $C_{10}H_8$ 1.2 kg, BTX 2.2 kg) flows out of the precooler and is pumped back through the line 3 to the collecting main 2. At the same time, a residue of 0.8 kg of crude tar from the following systems is added through the line 24. As a supplement to the recycling of the crude tar from the tar separator through the line 13 to the evaporation zone 14, the possibility is also indicated in FIG. 1 that a light tar-water mixture can be drawn off also from the tar separator and pumped (by pump 30) through the line 18 to the upper section of the precooler.

Figure 2:
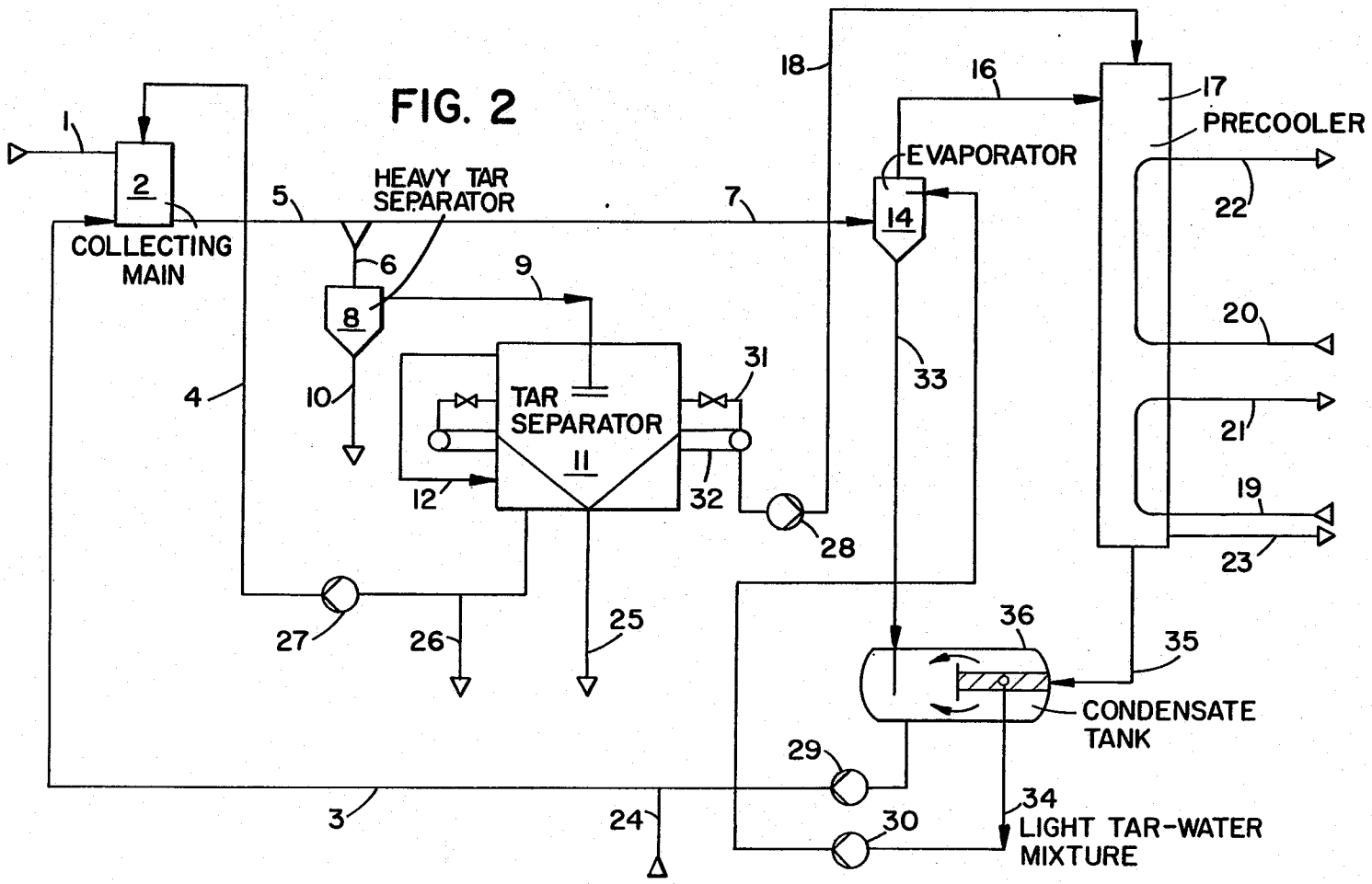
FIG. 2 is a view similar to FIG. 1 of another embodiment of the invention.

In departure from FIG. 1, it is provided in the diagram of FIG. 2 that the light tar-water mixture discharged from the precooler 17 is first collected in a condensate tank 36. The condensate tank 36 is designed so that a light tar-water mixture with a very high content of tar boiling below 200° C. is drawn off through the line 34, and is pumped (by pump 30) to the evaporator zone 14. The portion of this tar-water mixture not evaporating in the evaporator zone 14 is recycled through the line 33 to the condensate tank 36 and is pumped to the collecting main with the rest of the water through the line 3. It has been found that the light tar-water mixture leaving the precooler through the line 35 in this process method has a fraction of more than 10% of light tar boiling below 200° C. and a tar-water dispersion with more than 15% of tar boiling below 200° C. can be drawn off through the line 34 at a specific point in the condensate tank 36.

It is also indicated schematically in FIG. 2 that the light tar can be withdrawn from the tar separation tank 11 through several drain pipes, including light tar drain pipes 31, arranged on the circumference, and can be collected in an annular line ring header 32 before it is pumped (by pump 28) through the line 18 to the precooler 17. Tar for shipping is discharged through tar discharge 25. Spray water from line 4 is directed to collecting main 2, as in the embodiment of FIG. 1, by means of pump 27. Line 4 is connected to tar spray 11 near water discharge 12 and directed to the collecting main 2 via pump 29.

While specific embodiments of the invention have been shown and described in detail to illustrate the application of the principles of the invention, it will be understood that the invention may be embodied otherwise without departing from such principles.

What is claimed is:

1. A process for cooling crude coke oven gas drawn from a coke gas collecting main which has a crude coke oven gas and a flushing liquid down to a temperature of below 20° C., comprising separating the coke oven gas from the liquid of the collecting main, treating the crude coke oven gas with a tar and tar-water mixture withdrawn from the tar separator partially evaporating the more volatile components, and drawing off the remaining tar and the tar-water mixture and directing the gas through a precooler.

2. A process according to claim 1 wherein a tar-water emulsion with a tar fraction of from 50 to 100 grams per liter is added to the tar and water mixture.

3. A process according to claim 2 wherein a tar-water emulsion is also added to the precooler with the amount being determined by the temperature and the dissolving power for naphthalene.

4. A process according to claim 1 wherein the crude gas which is conducted from the collecting main to the precoolers at a temperature of from 80° to 82° C. is treated with a light tar and water mixture from the tar separator and includes a fraction of tar boiling below 200° C. in this mixture, which is from 1.5 to 2 times as high as the total crude tar.

5. A process according to claim 1 wherein a tar and water emulsion used for adding to the crude gas is taken from the end zone of the tar separator at several points on its circumference.

6. A process according to claim 1 wherein a light tar and water mixture is discharged from the precooler and it is divided into at least two fractions in a multipart condensate tank and a fraction with a high proportion of light tar boiling below 200° C. is sprayed into the crude gas and a fraction that does not evaporate and the rest of the tar and water mixture are used for spraying the collecting main.

7. A process for cooling crude coke oven gas drawn from a coke gas collecting main, the collecting main having crude coke oven gas and a flushing liquid, comprising the steps of: separating the coke oven gas from the flushing liquid; directing the flushing liquid to a tar separator; treating the crude coke oven gas with a tar and a tar-water mixture withdrawn from the tar separator; partially evaporating the more volatile components by passing the coke oven gas treated with the tar and tar-water mixture through an evaporator; and drawing off the remaining tar and tar-water mixture; and subsequent to said step of evaporating directing the gas through a precooler, the gas exiting the precooler at a temperature below 20° C.

8. A process according to the claim 7, wherein: a tar-wateremulsion with a tar fraction of from 50 to 100 grams per liter is added to the tar and water mixture.

9. A process according to claim 8, wherein: a tar-water emulsion is added to the precooler in an amount determined by the temperature and the dissolving power for naphthalene.

10. A process according to claim 7, wherein: a crude gas conducted from the collecting main to the precooler at a temperature of from 80° to 82° C. is treated with a light tar and water mixture from the tar separator including a fraction of tar boiling below 200° C., the fraction of tar boiling boiling below 200° C. is from 1.5 to 2 times as high as the total crude tar.

11. A process according to claim 7, wherein: a tar and water emulsion added to the crude gas is taken from the tar separator at several points about the circumference of the tar separator.

12. A process according to claim 7, wherein: a light tar and water mixture is discharged from the precooler and is divided into at least two fractions in a multi-part condensate tank, a fraction with a high proportion of light tar boiling below 200° C. being sprayed into the crude gas and a fraction that does not evaporate and the rest of the tar and water mixture being used for spraying the collecting main.

13. An apparatus for cooling crude coke oven gas drawn from a coke gas collecting main, the collecting main having a crude coke oven gas and a flushing liquid, down to a temperature of below 20° C., comprising: a conduit connected to the collecting main; separating means connected to said conduit for separating the coke oven gas from the flushing liquid of the collecting main; tar and tar-water conduit connected to the separator means and connected to the collecting main for treating the crude coke oven gas with a tar and tar-water mixture withdrawn from the separator means; evaporator means connected to said conduit for partially evaporating the more volatile components of said coke oven gas and drawing off the tar and tar-water mixture; evaporator discharge line connected to said evaporator for conveying crude gas enriched with low-boiling tar constituents from said evaporator; and, precooler means for receiving said crude gas enriched with low-boiling tar constituents from said evaporator and cooling said crude gas to a temperature below 20° C.

* * * * *